US009499238B1

(12) United States Patent
Lewis

(10) Patent No.: US 9,499,238 B1
(45) Date of Patent: Nov. 22, 2016

(54) PORTABLE ICE CRUSHER ASSEMBLY FOR A WATER VEHICLE

(71) Applicant: Nathanial Henry Lewis, Fallon, NV (US)

(72) Inventor: Nathanial Henry Lewis, Fallon, NV (US)

( * ) Notice: Subject to any disclaimer, the term of this patent is extended or adjusted under 35 U.S.C. 154(b) by 0 days.

(21) Appl. No.: 14/756,918

(22) Filed: Oct. 30, 2015

(51) Int. Cl.
*B63B 35/08* (2006.01)
*E02B 17/00* (2006.01)
*B63B 35/12* (2006.01)

(52) U.S. Cl.
CPC ..... *B63B 35/083* (2013.01); *B63B 35/12* (2013.01); *E02B 17/0021* (2013.01)

(58) Field of Classification Search
CPC B63H 21/36; B63H 20/32; B63H 2020/323; B63H 2020/326; B63H 20/34; E02B 17/0021
See application file for complete search history.

(56) References Cited

U.S. PATENT DOCUMENTS 3,668 A * 7/1844 Nicholson ..... B63B 35/12 114/42
17,052 A * 4/1857 Oram ..... B63B 35/08 114/40
588,393 A * 8/1897 Brown ..... B63B 35/12 114/42
3,658,024 A * 4/1972 Stoffel ..... B63B 35/10 114/40
3,670,681 A * 6/1972 Upchurch, Jr. ..... B63B 35/08 114/40
4,276,845 A * 7/1981 Spanner ..... B63B 35/08 114/42

* cited by examiner

*Primary Examiner* — Andrew Polay

(57) ABSTRACT

A portable ice crusher assembly to be mounted on the bow of an icebreaker. The main sections are a deck support assembly, a deck power assembly and a front support assembly with a hanging container with weights within, and sharp pointed spikes at its bottom. The ice crusher assembly breaks up the ice in front of the icebreaker by dropping the container onto it. Instead of breaking the ice with a ship's hull an ice crusher assembly can be used.

1 Claim, 2 Drawing Sheets

PORTABLE ICE CRUSHER ASSEMBLY FOR A WATER VEHICLE

BACKGROUND OF THE INVENTION

Icebreakers could be built faster and with less expense. Instead of breaking the ice with a ship's hull an ice crusher assembly can be used. A new icebreaker can be built or an existing ship can be modified. The speed of breaking the ice could increase as well. The Coast Guard's heavy polar icebreakers are capable of continuous progress through ice 6 feet thick at a speed of 3 knots, for ice at 21 feet an icebreaker has to use the backing and ramming technique. This is very hard on the icebreaker's hull and engines, perhaps the crew as well.

SUMMARY OF THE INVENTION

A portable ice crusher assembly can be made in many sizes. The polar icebreakers are needed to support research operations in the Arctic and Antarctic. Much of the expensive special steel can be avoided by using this ice crusher. There are icebreaking tugs on the Great Lakes and along U.S. coastal waters. A great saving in fuel cost for the Coast Guard would be a by-product.

The main sections are a deck support assembly, a deck power assembly and a front support assembly with a hanging container with weights within, and sharp pointed spikes at its bottom. The ice crusher assembly breaks up the ice in front of the icebreaker by dropping the container on to it.

DETAIL DESCRIPTION

Figure 1:
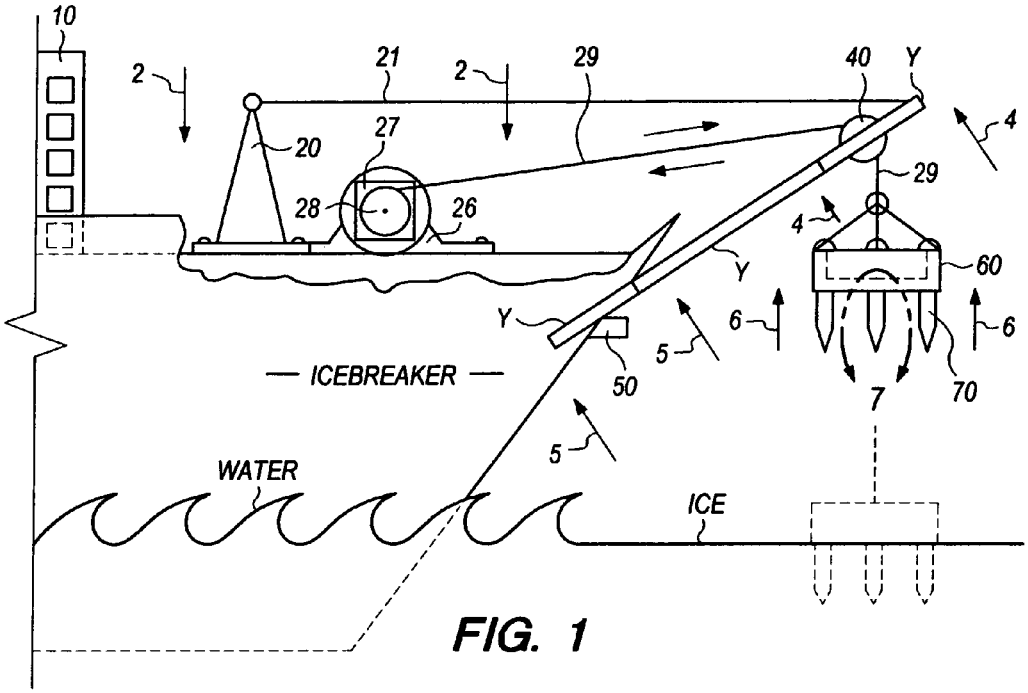
FIG. 1 is a side view of a portable ice crusher assembly, mounted on the bow of an icebreaker.

Refer to FIG. 1. A portable ice crusher assembly mounted on the bow of an icebreaker (water vehicle). The main sections are a deck support assembly, a deck power assembly, a front support assembly Y and a hanging container 60. The bridge 10 is shown.

The deck support assembly comprises a vertical support structure 20 and a stabilizing stationary cable 21. The deck power assembly comprises an electric motor 26, an electric clutch 27 and a power pulley 28 with its movable cable 29. The front support assembly Y comprises a free rolling pulley 40 at its upper end, and at its lower end there is a mounting means. This mounting means can be a mounting structure on the bow, or a peg 50 inserted and protruding from the bow of the icebreaker.

Figure 2:
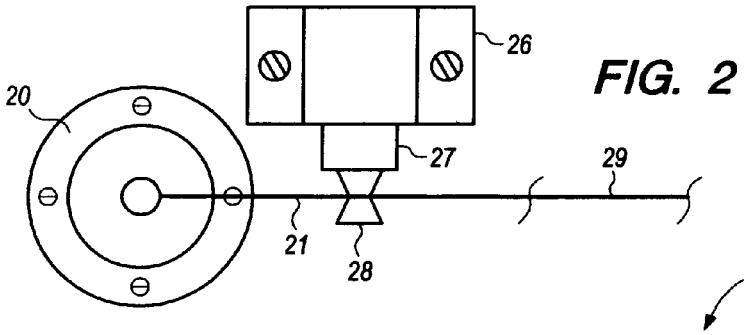
FIG. 2 is a top view of a vertical support structure and its stabilizing stationary cable, an electric motor-clutch assembly and a power pulley with its movable cable.
Figure 3:
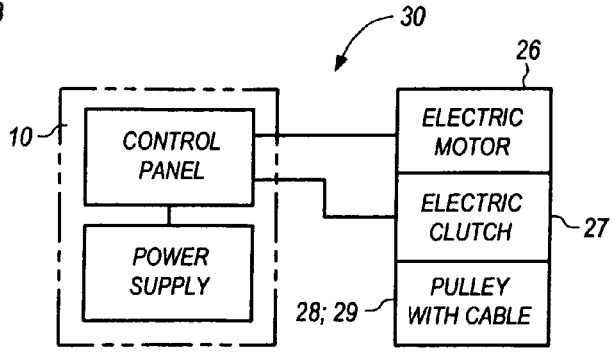
FIG. 3 is a block diagram of an electrical system of the portable ice crusher assembly.

Refer to FIG. 2. This top view show the support structure 20 and its stationary cable 21 adjacent the motor 26, clutch 27 and pulley 28 with its movable cable 29. The electrical system 30 of the ice crusher assembly is shown in FIG. 3. It connects the entire assembly electrically.

Figure 4:
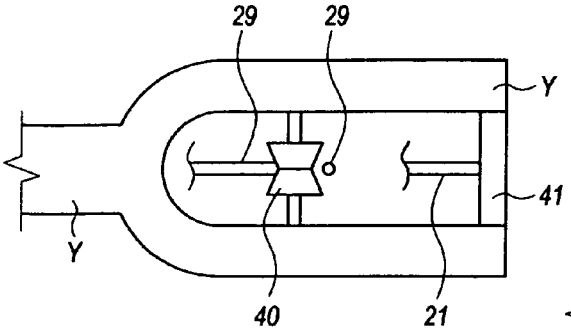
FIG. 4 is a bottom view of an upper end of a front support assembly.
Figure 5:
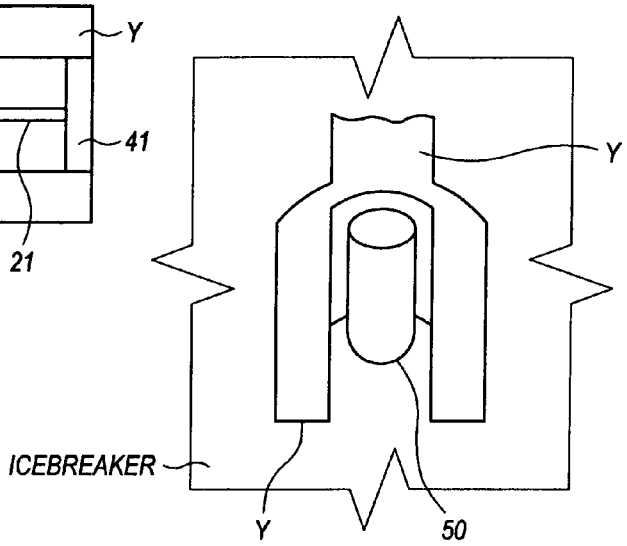
FIG. 5 is a bottom view of a lower end of the end of the front support assembly.

Refer to FIG. 4. The upper end of the front support assembly Y comprises a cable holding bar 41 for the stationary cable 21. The upper pulley 40 supports the movable cable 29. Refer back to FIG. 1. The hanging container 60 is attached at its top to the movable cable 29 by way of the free rolling, upper pulley 40, the cable 29 is attached to the power pulley 28. Refer to FIG. 5. The lower end of the front support assembly Y is mounted on the peg 50 and close to the bow of the icebreaker.

Figure 6:
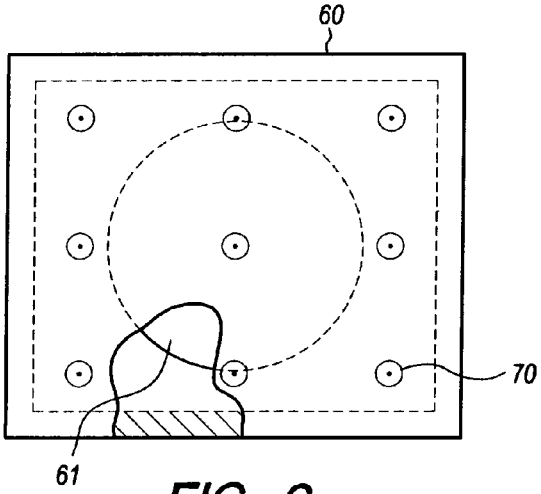
FIG. 6 is a bottom view of a hanging container holding some weights and with spikes in its bottom.

The bottom of the container 60 is shown in FIG. 6. The container 60 is designed to hold weights 61 of different shapes and sizes. There are several spikes 70 screwed into its bottom.

Figure 7:
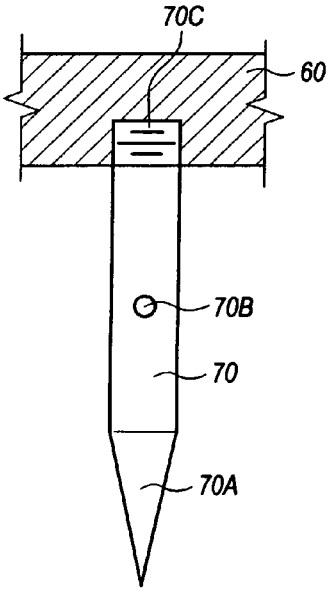
FIG. 7 is a partial enlarged view showing a pointed spike screwed into the container shown section.

In FIG. 7, one end 70C of each spike 70 can be screwed into the bottom of the container 60. A metallic rod can be inserted into the hole 70B to turn the spike 70. A good hard point 70A will be needed. There are other means for fastening a spike 70 to the bottom of the container 60, such as bolting or welding. To remove a spike 70 from the container 60 it can have slotted surfaces for fitting a wrench, in the place of the hole 70B.

Ahead of an icebreaker there is a weighted container 60 having spikes 70 with strong and sharp points 70A. When the container 60 is dropped from a height this would do serious damage to the ice below. This portable ice crusher assembly requires no new technology.

I claim:

1. A portable ice crusher assembly for mounting on a deck of a ship comprising:

a) A ship with a deck that extends to a forward deck end at a bow of the ship;

b) An ice crusher support assembly comprising:

A vertical support structure mounted on the deck of the ship;

A front support assembly comprising a proximal end and a distal end wherein the proximal end is mounted on the bow or a peg protruding from the bow:

The distal end of the front support assembly extends forward of the forward deck end wherein the distal end comprises a holding bar and an upper pulley;

A stationary cable wherein the stationary cable extends from the vertical support structure to the holding bar;

c) An ice crusher comprising a weighted container with a plurality of spikes fastened to a bottom of the weighted container;

d) A deck power assembly comprising an electric motor, an electric clutch, a power pulley, and a moveable cable attached to the power pulley;

e) Wherein the moveable cable extends around the upper pulley to suspend the ice crusher at a height above ice.

* * * * *